United States Patent [19]

Guckert et al.

[11] Patent Number: 5,013,599

[45] Date of Patent: May 7, 1991

[54] COMPOSITE FIBROUS POLYETHYLENE SHEET

[75] Inventors: Joseph R. Guckert, Midlothian; Hyun S. Lim, Chesterfield, both of Va.

[73] Assignee: E. I. Du Pont de Nemours and Company, Wilmington, Del.

[21] Appl. No.: 497,217

[22] Filed: Mar. 15, 1990

Related U.S. Application Data

[62] Division of Ser. No. 415,831, Sep. 29, 1989, Pat. No. 4,941,947.

[51] Int. Cl.[5] ..... B32B 27/00

[52] U.S. Cl. ..... 428/286; 428/284; 428/283; 428/296; 428/297; 428/298; 428/327; 428/340

[58] Field of Search ..... 428/284, 286, 296, 297, 428/298, 340, 283, 327

[56] References Cited

U.S. PATENT DOCUMENTS

| | | | |
|---|---|---|---|
| 3,169,899 | 2/1965 | Steuber | 161/72 |
| 4,608,089 | 8/1986 | Gale et al. | 106/90 |
| 4,647,497 | 3/1987 | Weeks | 428/284 |
| 4,737,394 | 4/1988 | Zafiroglu | 428/283 |

OTHER PUBLICATIONS

Kirk-Othmer: Encyclopedia of Chemical Technology, vol. 19, 3rd Ed. John Wiley & Sons, pp. 420-435 (1982).

*Primary Examiner*—James J. Bell

[57] ABSTRACT

A bonded composite sheet comprising a layer of flash-spun polyethylene plexifilamentary film-fibril strand sheet in face-to-face contact with a layer of polyethylene synthetic pulp is highly suited for detailed printing thereon.

4 Claims, 2 Drawing Sheets

COMPOSITE FIBROUS POLYETHYLENE SHEET

REFERENCE TO RELATED APPLICATION

This application is a division of application Ser. No. 07/415,831, filed Sept. 29, 1989 now U.S. Pat. No. 494,947.

BACKGROUND OF THE INVENTION

1. Field of the Invention

The present invention relates to a composite sheet comprising layers of fibrous polyethylene. More particularly, the invention concerns such a sheet that is particularly useful as a substrate for printing.

2. Description of the Prior Art

Spunbonded fibrous sheet made of multiple plexifilamentary strands of oriented polyethylene film fibrils is known from, for example, Steuber, U.S. Pat. No. 3,169,899. Such sheet has been produced commercially by E. I. du Pont de Nemours and Company under the trademark "Tyvek" spunbonded olefin. The sheet has proven useful in many diverse applications, which take advantage of its unusually good combination of strength, tear and permeability properties, among others. However, in certain printing applications, improvement in the spunbonded fibrous polyethylene sheets are still desired. For example, in high density bar-code printing, the present inventors have found that the sheets sometimes exhibit inadequate print clarity. Accordingly, a purpose of the present invention is to improve the fibrous polyethylene sheet so that it performs satisfactorily in high density bar-code printing.

Even though the spunbonded fibrous polyethylene sheets are quite uniform, the present inventors found that the cause of the printing clarity problem was inadequate sheet-thickness uniformity.

Synthetic pulps of polyethylene are known in the art. *Kirk-Othmer: Encyclopedia of Chemical Technology*, volume 19, third edition, John Wiley & Sons, p. 420–435 (1982) describes synthetic pulps as generally being very fine, highly branched, discontinuous, water-dispersible fibers made of plastics. Known methods for producing the synthetic pulps include solution flash-spinning, emulsion flash-spinning, melt-extrusion/fibrillation and shear precipitation. The pulps may be blended with other fibers and made into papers, sheets or boards by conventional wet-lay papermaking techniques. Such pulps have also been used as bonding agents for certain nonwoven materials such as dry-laid, Rando-Webber formed sheets and wet-laid, Fourdrinier-formed sheets.

Gale et al, U.S. Pat. No. 4,608,089, discloses forming oriented polyethylene film-fibril pulps by cutting a flash-spun polyethylene sheet (e.g., Tyvek®) into pieces, forming an aqueous slurry with the pieces and then refining the pieces with disc refiners to form a pulp that is particularly suited for cement reinforcement.

Composite nonwoven sheets also are known. For example, Weeks, U.S. Pat. No. 4,647,497, discloses a calendered composite nonwoven sheet comprising (a) a nonwoven scrim of continuous filaments of about 1 to 10 dtex per filament, preferably of polyester, polypropylene or nylon, (b) an abrasion-resistant synthetic pulp layer, preferably of polyethylene and (c) an adhesive binder which adheres the scrim to the pulp layer. The composite sheet is especially suited for air-infiltration barriers and outdoor signs and banners.

SUMMARY OF THE INVENTION

The present invention provides a nonwoven composite sheet comprising a layer of flash-spun polyethylene plexifilamentary film-fibril strand sheet in face-to-face contact with a layer of polyethylene synthetic pulp. Preferably, the flash-spun sheet layer has a weight in the range of 25 to 100 g/m$^2$ and the synthetic pulp layer has a weight in the range of 8.5 to 85 g/m$^2$ and the total weight of the composite sheet is no more than about 135 g/m$^2$. Most preferably, the layer of continuous plexifilamentary strands has a weight in the range of 40 to 70 g/m$^2$ and the layer of synthetic pulp has a weight in the range of 15 to 35 g/m$^2$. In a preferred embodiment, the layers are thermally bonded to each other. In another preferred embodiment, the composite sheet is calendered. The composite sheets preferably have a coefficient of variation of sheet thickness of no greater than 10%.

The present invention also provides a process for preparing the nonwoven composite sheet in which a layer of wet polyethylene synthetic pulp is formed on a paper-making machine and then is combined with a continuous filament nonwoven sheet to form a sheet assembly which is dewatered and dried to form the nonwoven composite sheet. In the process of the invention, the nonwoven continuous filament sheet is a lightly consolidated sheet of flash-spun plexifilamentary strands of oriented polyethylene film-fibrils which is laid atop the wet pulp layer at a point in the paper-making process where the wet pulp layer has a water content in the range of 99 to 50 percent by total weight of the wet pulp layer.

BRIEF DESCRIPTION OF THE DRAWING

The invention will be more readily understood by referring to the drawings, which are schematic representations of equipment suitable for making composite sheet of the invention.

DETAILED DESCRIPTION OF PREFERRED EMBODIMENTS

In a accordance with the present invention, a laminate is made of a sheet of plexifilamentary polyethylene film-fibril strands and a synthetic pulp of polyethylene.

The sheet of flash-spun polyethylene plexifilamentary film-fibril strands is made by the general method of Steuber, U.S. Pat. No. 3,169,899, the disclosure of which is hereby incorporated by reference. The sheets are prepared by flash-spinning from multiple position solutions of polyethylene in an organic solvent into plexifilamentary film-fibril strands which are deposited and combined on a moving surface to form a sheet, which is then lightly consolidated and wound into a roll. For use in the present invention, suitable lightly consolidated spunbonded polyethylene film-fibril sheets have thicknesses in the range of 0.13 to 0.33 mm and weights in the range of 25 to 100 g/m$^2$, preferably 40 to 70 g/m$^2$.

Polyethylene synthetic pulps that are suitable for use in the present invention include PulPlus ™ (made by E. I. du Pont de Nemours and Company), "SWP" (distributed by Mini-Fibers, Inc., of Johnson City, Tenn.), "Pulpex" (made by Lextar, a company of Hercules, Inc., of Wilmington, Del.) and the like. PulPlus ™ is made by the general methods disclosed by Gale et al, U.S. Pat. No. 4,608,089, which disclosure is hereby incorporated by reference, and is preferred for use in the present invention because the melting temperatures of the pulp made by these methods most closely match those of the layer of flash-spun polyethylene plexifilamentary film-fibril strand sheet. The close match of melting temperatures permits better and more readily controllable thermal bonding between the pulp and sheet layers. For use in the present invention, the pulps, when laminated to the sheet layer, add about 8.5 to 85 g/m$^2$, preferably 15 to 60 g/m$^2$ to the weight of the sheet.

Figure 1:
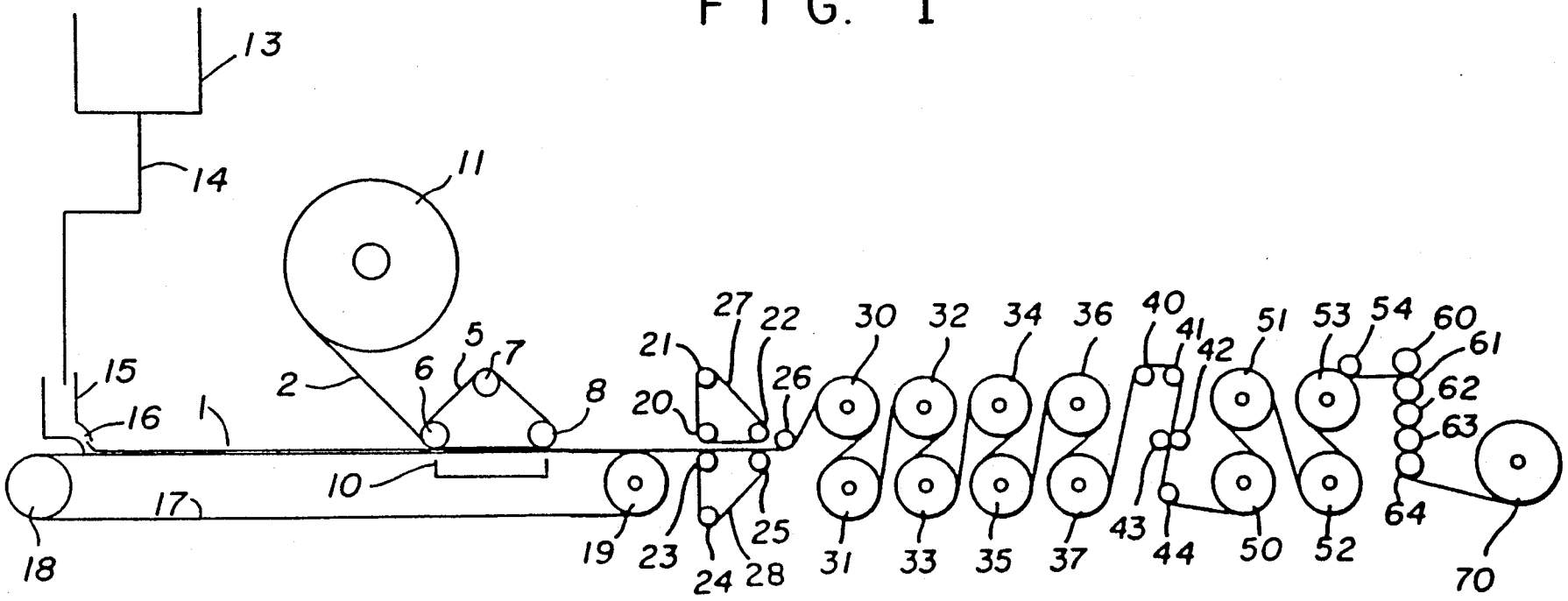
FIG. 1 depicts a Foudrinier machine wherein a wet-laid layer of polyethylene synthetic pulp 1 is advanced on a forming wire 17 to a position at which a lightly consolidated sheet 2 of flash-spun polyethylene plexifilamentary film-fibril strands supplied from roll 11, is laid upon the wet-laid pulp layer. These two layers undergo an initial consolidation between top-wire assembly 5 and forming wire 17, and then the consolidated layers pass as an assembly through a press section (rolls 20–25 and belts 27 and 28), a primary dryer section (cans 30–37), a size press section (rolls 40–44), a secondary drier section (cans 50–54) and a calendar stack (rolls 60–64) and then to a windup to form roll 70 of the composite sheet.
Figure 3:
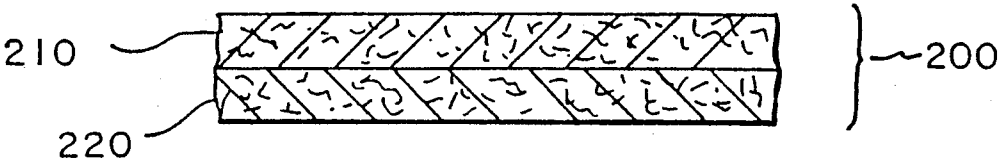
FIG. 3 depicts a cross-section of composite sheet 200 which comprises a layer 210 of polyethylene synthetic pulp and a layer 220 of plexifilamentary polyethylene film-fibril strands.

In practicing the process of the invention, a conventional Foudrinier paper-making machine can be employed, with certain minor modifications. The modifications involve the addition of (see FIG. 1) an unwind stand (not shown) for roll 11 of flash-spun polyethylene film-fibril sheet 2 and an initial compression zone formed by forming wire 17 and top wire 5. Roll 11 is accurately aligned with forming wire 17 to avoid the formation of wrinkles in the product being formed. The drives (not shown) of the paper-making machine provide sufficient force to unwind the sheet from the roll. Usually, the unwind stand has a small brake to provide tension to the sheet.

Pulp 1 is floated onto the forming wire by conventional paper-making techniques. Sheet 2 is placed atop pulp 1 on forming wire 17 because of the low porosity and hydrophobic nature of sheet 2. In conventional methods of forming pulp sheets reinforced with scrims the pulp is usually laid atop the scrim. Because pulp 2, with its very high moisture content (preferably 94–98.5%), is very mobile, when compression is applied to the combined pulp and sheet, the pulp flows more into thinner areas of the sheet. This produces a laminate of improved thickness uniformity. Only a small amount of pulp is necessary; the sheet provides the necessary strength for carrying the wet laminated to the press section (rolls 20–25 and belts 27–28). The laminate is initially consolidated between top wire 5 and forming wire 17. Additional consolidation is provided by the press section (30–37) and drying sections (30–37 and 50–53).

It is also sometimes desirable to combine pulp 1 and sheet 2 at the first rolls 20 and 23 of the dewatering press. However, when the moisture content of the pulp is less than 50%, the pulp layer does not adhere to the sheet.

Figure 2:
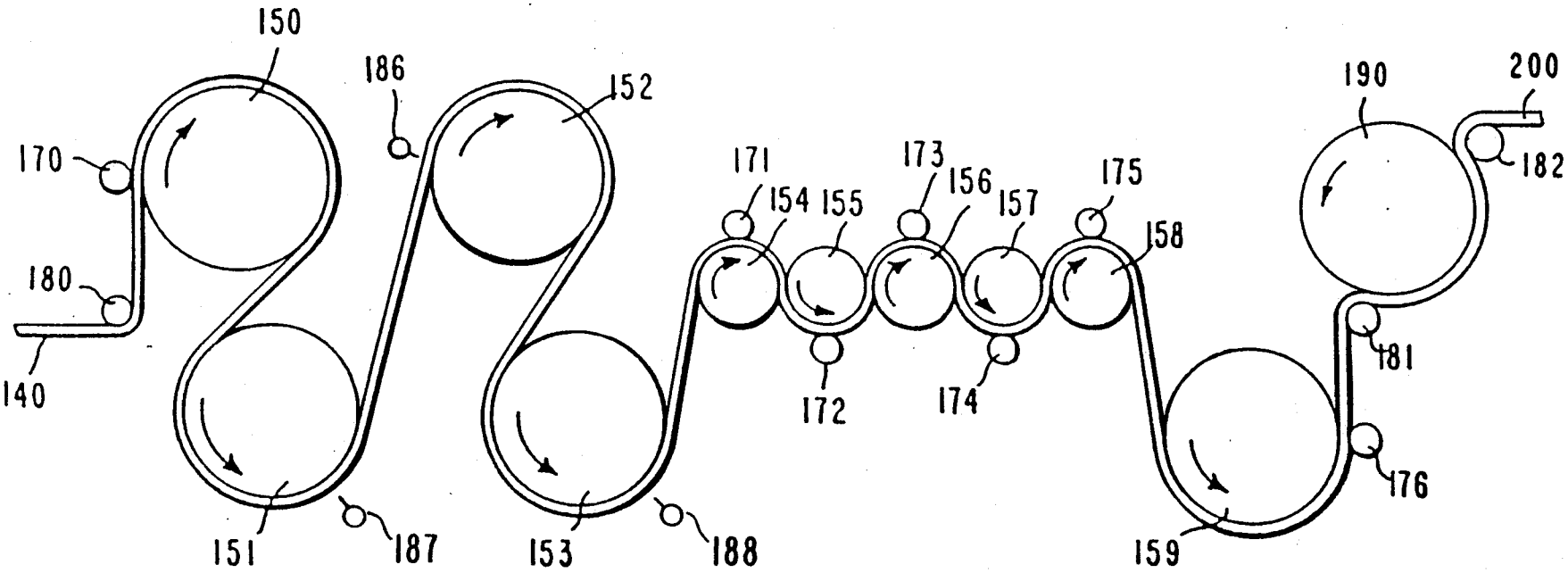
FIG. 2 depicts a calender apparatus suitable for bonding layers of the composite nonwoven sheet 140 together. The calender comprises multiple, internally heated rolls 150–158, internally cooled rolls 159 and 190, idler rolls 180 and 182, corona discharge wands 186–188, and rubber-coated nip rolls 170–176 and 182.

The bonding or finishing of the laminated sheet can be accomplished with conventional equipment, such as calender roll stacks. Particularly preferred equipment for carrying out the bonding is shown in FIG. 2 as described above. The equipment is similar to that disclosed by Lee, U.S. Pat. No. 4,554,207. For the laminating operations described herein, all rolls were operated at substantially the same peripheral speeds. The temperature of the interface between the pulp and the plexifilamentary strand sheet was raised sufficiently to bond the two layers together.

If desired, the bonding of the laminate can be augmented with latex binders or thermally fusible fibers. Latex binders of the kind disclosed by Weeks, U.S. Pat. No. 4,647,497, are suited for this purpose. The latex binders can be applied to the polyethylene film-fibril sheet or can be included in the pulp furnish. The fusible fibers can be added directly to the pulp furnish. The melting point of the fusible fibers should be lower than that of the pulp fibers. For example, a suitable fusible fibers for use with pulps of Pulplus$^{200}$ (sold by E. I. du Pont de Nemours and Company) are Pulpex ® EA (sold by Hercules, Incorporated) fibers which have a melting temperature that is about 4° C. lower than that of the Pulplus ®.

Various characteristics and properties of the composite sheet referred to herein are measured by the following procedures, in which ASTM refers to the American Society of Testing and Materials.

Sheet weight is measured in accordance with ASTM D3776-79 and is reported in grams per square meter.

Tensile strength, which is reported in Newtons, is measured as follows. A 1.0-inch (2.54-cm) wide by 8.0-inch (20.3-cm) long strip of sheet is mounted in the clamps of a Constant Rate-of-Extension Instron Tensile Testing Machine. A continuously increasing load is applied longitudinally to the strip longitudinally. The load at rupture is the tensile strength (or breaking load).

Elmendorf tear strength is measured in accordance with ASTM D1424-83, but with the specimen size set forth for film in ASTM D1922-67(1978), and is reported in Newtons.

Delamination resistance is measured Lim, U.S. Pat. No. 4,652,322, column 4 line 58 column 5, line 7, which description is hereby incorporated by reference. Results are reported in Newtons per centimeter.

Sheet thickness and thickness uniformity is measured with a beta-gauge, by the method described in detail in Lim, U.S. Pat. No. 4,652,322, column 5, lines 21–32, which is hereby incorporated by reference.

The invention is further illustrated by the examples which follow. These examples are included for the purposes of illustration and are not intended to limit the scope of the invention, which is defined by the appended claims. The results reported in the examples are believed to be representative, but do not constitute all the runs involving the indicated materials.

EXAMPLE 1

This example illustrates the surprisingly large improvement in thickness uniformity obtained when composite sheets are made in accordance with the present invention.

A composite sheet of the invention was made by combining a 17.0-g/m$^2$ layer of polyethylene synthetic pulp (PulPlus ™) with a 42.4-g/m$^2$ layer of lightly consolidated, flash-spun polyethylene plexifilamentary film-fibril strand sheet and then bonding the two layers together, substantially as shown in Example 2 below. The average thickness of the composite sheet was measured with a Beta-gauge (16,920 points, 5 readings per inch) to average 0.187±0.021 millimeter. The value quoted is the average value, X, plus or minus one standard deviation, $\sigma$ (i.e., $X \pm \sigma$). The coefficient of variation is simply the standard deviation divided by the average, expressed as a percentage (i.e., $\%CV = 100\sigma/X$).

The composite sheet of this example was much more uniform than would have been expected from a simple combination of a plexifilamentary substrate sheet with a pulp of perfectly uniform thickness. The average thickness of a bonded 41.1-g/m$^2$ flash-spun polyethylene plexifilamentary film-fibril strand sheet was measured to be 0.162±0.025, which corresponds to a coefficient of variation of 15.4%. If a pulp layer, weighing about 17 g/m$^2$ and having an average thickness of 0.025±0 mm (i.e., no thickness variation) were to be combined with the flash-spun polyethylene plexifilamentary film-fibril strand sheet, the resulting composite sheet would have an average thickness of 0.187±0.025 mm, obtained by adding the total thickness of the pulp layer to the thickness of the plexifilamentary strand sheet, or a CV of 13.4%. The thickness uniformity of the composite sheet made in this example had a $\sigma$ of±0.021, or a CV of 9.3%. Thus, the coefficient of variation of thickness, surprisingly, was about 30% smaller than that theoretically obtainable with a pulp of perfectly uniform thickness.

When the composite sheet of this example was used for high resolution printing, even when printed on the plexifilamentary strand layer surface, the resultant printed matter was much clearer than when a plexifilamentary strand sheet (with no pulp layer) of the same total weight, same average thickness and same surface treatment was printed in the same way.

EXAMPLES 2–7

This example illustrates the production of a series of composite sheets of the invention and further demonstrates the advantageous improvements obtained by the invention in sheet thickness uniformity.

PulPlus™ polyethylene synthetic pulp was screened through a Bird Model-100 Centrisorter (sold by Bird Machine Co., South Walpole, Mass.) equipped with a 0.045-inch plate. The plate was perforated with a multiplicity of 0.045-inch (0.114-cm) diameter holes. Screened pulp, weighing in the range of 17.0 to 64.4 g/m$^2$, was combined on a Fourdrinier paper-making machine of the type shown in FIG. 1, with lightly consolidated, flash-spun polyethylene plexifilamentary film-fibril strand sheet weighing in the range of 41.0 and 52.2 g/m$^2$. The machine was operated with a speed of 100 feet per minute (30.5 m/min), with free dewatering (i.e., no vacuum under screen 17) and with nip loads of 280 pounds per linear inch (50 kg/cm) between rolls 20 and 23, 180–230 lb/in (32.2–41.2 kg/cm) between rolls 22 and 25, and 125 lb/in (22.4 kg/cm) between rolls 42 and 43. A lump-breaker roll was employed atop forming wire 17 immediately above couch roll 19. Rolls 60 and 64 were by-passed.

The moisture content of the pulp at a place on the Fourdrinier machine about 30 cm upstream of where the pulp and sheet were combined was in the range of 97.8 to 99.6% . Other tests showed that at moisture contents of 94.5% excellent formation (i.e., uniformity) of the wet is obtained. Even when moisture content is as low as 50%, adequate lamination can be obtained.

After passage through the drying can section of the paper-making machine, dried composite was bonded in an apparatus of the type depicted in FIG. 2. Layer weights and bonding conditions are summarized in Table 1.

TABLE 1

| | Composite Sheet Production* | | | | | |
|---|---|---|---|---|---|---|
| | Example | | | | | |
| | 2 | 3 | 4 | 5 | 6 | 7 |
| Weight, g/m$^2$ | | | | | | |
| Sheet | 41.1 | 41.1 | 41.1 | 41.1 | 52.9 | 52.9 |
| Pulp | 17.0 | 23.7 | 33.9 | 50.9 | 64.4 | 50.9 |
| Total | 58.0 | 64.7 | 74.9 | 91.9 | 117.3 | 103.8 |
| % Moisture | 98.6 | 98.5 | 98.3 | 98.0 | 98.0 | 97.8 |
| Temperatures of rolls,° C. | | | | | | |
| 150,151 | 116 | 117 | 116 | 117 | 118 | 117 |
| 152 | .132 | 139 | 142 | 141 | 141 | 139 |
| 153 | 127 | 127 | 138 | 132 | 132 | 137 |
| 154 | 138 | 138 | 137 | 135 | 133 | 132 |
| 155 | 132 | 132 | 132 | 137 | 137 | 137 |
| 156 | 141 | 143 | 141 | 143 | 143 | 139 |
| 157 | 135 | 135 | 139 | 143 | 138 | 142 |
| 158 | 135 | 138 | 138 | 143 | 143 | 143 |
| 159 | 40 | 40 | 40 | 40 | 40 | 40 |
| 190 | <10 | <10 | <10 | <10 | <10 | <10 |

*Notes:
Peripheral speed of all rolls = 30.5 meters/sec
% moisture content of pulp at a location 30 cm upstream of place where pulp and sheet were combined.

The thicknesses, tensile and tear strengths, delamination resistance and uniformities of the composite sheets of the invention of Examples 2–7 were compared to those of commercial, bonded, flash-spun polyethylene plexifilamentary film-fibril strand sheet, designated "C" in Table 2, below. Comparison C was a Style 1073B Tyvek® spunbonded olefin sheet (sold by E. I. du Pont de Nemours and Company) which weighted 74.6 g/m$^2$.

The data in Table 2 clearly demonstrate the significant improvement in thickness uniformity of the composite products of the invention over the commercial product. The thickness of the composites had coefficients of variation ranging from 6.6-to-9.8% versus 13.4% for the commercial product. Table 2 also shows that thickness uniformity also improves with increasing pulp weight.

TABLE 2

| | Properties of Composites* | | | | | | |
|---|---|---|---|---|---|---|---|
| | Sample | | | | | | |
| | 2 | 3 | 4 | 5 | 6 | 7 | C |
| Thickness | | | | | | | |
| Average | 0.191 | 0.226 | 0.221 | 0.282 | 0.307 | 0.300 | 0.208 |
| minimum | 0.135 | 0.173 | 0.160 | 0.221 | 0.246 | 0.234 | 0.122 |
| maximum | 0.246 | 0.282 | 0.282 | 0.343 | 0.368 | 0.368 | 0.295 |
| $\sigma$ | 0.019 | 0.018 | 0.021 | 0.021 | 0.020 | 0.022 | 0.028 |
| % CV | 9.8 | 8.0 | 9.3 | 7.2 | 6.6 | 7.5 | 13.4 |
| Tensile | | | | | | | |
| MD | 5.25 | 5.95 | 5.95 | 5.60 | 6.48 | 7.35 | 7.70 |
| XD | 4.03 | 4.73 | 4.38 | 5.08 | 5.43 | 5.95 | 8.75 |
| Tear | | | | | | | |
| MD | 3.99 | 3.10 | 3.99 | 3.54 | 3.99 | 6.20 | 3.99 |
| XD | 4.43 | 2.66 | 3.99 | 3.10 | 3.99 | 5.31 | 3.99 |

TABLE 2-continued

| | Properties of Composites* | | | | | | |
|---|---|---|---|---|---|---|---|
| | Sample | | | | | | |
| | 2 | 3 | 4 | 5 | 6 | 7 | C |
| Delam. | 0.71 | 1.01 | 0.80 | 0.54 | 0.44 | 0.56 | 0.82 |

Notes*
Thicknesses and $\sigma$, in millimeters, were each derived from 2,700 $\beta$-gauge measurements.
MD = machine or longitudinal direction
XD = cross-machine or transverse direction
Delam. = delamination resistance The advantage of the improved thickness uniformity of the composite sheet of the invention over commercial, bonded, flash-spun polyethylene film-fibril strand sheet of the same weight was illustrated by a "bar-code legibility" printing test with composite sheets of Example 4 and comparison sheet "C". Each test sheet weighed about 74.5 g/m$^2$. A high-density "39" bar code having a bar thickness of 0.0075 inch (0.0191 cm) was printed on each test sample with a jet black, water-base ink (sold by Environmental Ink Co. of Morgantown, N.C.) on a Webtron 1600 flexograph printing press (manufactured by Webtron of Fort Lauderdale, Fla.) on which a 0.067-inch (0.171-cm) thick "Cyrel" photopolymer printing plate (manufactured by E. I. du Pont de Nemours and Company) was mounted with 0.020-inch (0.051-cm) thick, cushion-backed foam tape. High density, bar code 39 is described by D. C. Allais, "Bar Code Symbologe, Some observations on theory and practice" (Dec. 1, 1984), Intermec Company, Linwood, Wash., which description is hereby incorporated by reference. The composite sheets of the invention were printed on the film-fibril sheet side, rather than on the pulp side. The printed bar code was read with a "Lasercheck" reader, (Model no. LC2811 manufactured by Symbol Technologies, Inc. of Bohemia, N.Y.) to determine whether the printed matter could be read. Printed matter than can be read with the Lasercheck reader 85% of the time is considered satisfactory for commercial use. The measured percent of successful readings for each of several sheet samples was as follows:

| Sheet Sample | % Successful Readings |
|---|---|
| Example 4 | 96, 98, 91, 92 |
| Comparison C | 50, 29, 48, 52, 29 |

These results clearly demonstrated that the printed composite sheet of the invention was much more readable than the printed comparison sheet.

We claim:

1. A composite sheet particularly suited for detailed printing thereon comprising a first layer in face-to-face contact with a second layer, the first layer consisting essentially of flash-spun polyethylene plexifilamentary film-fibril strand sheet, having a weight in the range of 25 to 100 g/m$^2$, the second layer consisting essentially of a layer of polyethylene synthetic pulp having a weight in the range of 8.5 to 85 g/m$^2$, the first and second layers being thermally bonded to each other and the composite sheet having a total weight of no more than about 135 g/m$^2$ and a coefficient of variation of sheet thickness of no greater than 10%.

2. A composite sheet in accordance with claim 1 wherein the layer of plexifilamentary strand sheet weighs in the range of 40 to 70 g/m$^2$, the layer of synthetic pulp weighs in the range of 15 to 60 g/m$^2$ and the composite as an average thickness in the range of 0.19 to 0.31 mm.

3. A composite sheet in accordance with claim 1 or 2 wherein the composite sheet is a calendered sheet.

4. A composite sheet in accordance with any one of the preceding claims, having a coefficient of variation of sheet thickness of no greater than 10%.

* * * * *